US006959532B2

(12) United States Patent
Wüst et al.

(10) Patent No.: US 6,959,532 B2
(45) Date of Patent: Nov. 1, 2005

(54) METHOD AND DEVICE OF PIECING OR STARTING OF SPINNING FOR SPINNING POSITIONS OF AIR SPINNING FRAMES

(75) Inventors: Olivier Wüst, Seuzach (CH); Herbert Stalder, Kollbrunn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 182 days.

(21) Appl. No.: 10/464,054

(22) Filed: Jun. 18, 2003

(65) Prior Publication Data

US 2004/0045270 A1 Mar. 11, 2004

(51) Int. Cl.[7] ..... B65H 69/06
(52) U.S. Cl. ..... 57/22; 57/263
(58) Field of Search ..... 57/22, 261, 263, 57/315, 318, 328, 333, 350, 400

(56) References Cited

U.S. PATENT DOCUMENTS 5,339,614 A 8/1994 Witschi
5,524,427 A 6/1996 Sekiya et al.
5,802,831 A 9/1998 Imamura
5,809,764 A 9/1998 Baba
5,934,058 A 8/1999 Hirao et al.
6,691,501 B2 * 2/2004 Anderegg et al. ..... 57/263
2002/0124545 A1 9/2002 Griesshammer et al.
2002/0144496 A1 10/2002 Anderegg et al.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

The invention concerns a start of spinning or the method of piecing for spinning positions of air spinning frames, which, during a spinning process, produce a thread from a longitudinal fiber structure and which, for this, comprise a fineness influencing unit with parts drivable at the inlet side and part drivable at the outlet side with clamping points, a means for the air twist generation and a means for the thread take-off, whereby, after an interruption of the spinning process, the resumption of the production of the thread comprises the following steps. In particular, the method does provide for,that the start-up of the part of the drafting unit, driven at the outlet side, takes place with a subsequent time coordinated and delayed start-up of the part driven at the inlet side, in such a manner that the end portions of the torn longitudinal fiber structure and of the thread end overlap and pass, in overlapping condition, the clamping point of the part driven at the outlet side.

18 Claims, 1 Drawing Sheet

METHOD AND DEVICE OF PIECING OR STARTING OF SPINNING FOR SPINNING POSITIONS OF AIR SPINNING FRAMES

BACKGROUND OF THE INVENTION

The invention concerns the field of spinning mill technology and relates to a method and device of piecing a yarn on a spinning frame. The method according to the invention serves for piecing the yarn which is formed of a staple fiber material in a spinning frame and/or in a spinning position of an air spinning frame, for example, after a can change, after a bobbin change, after a yarn breakage or after another spinning disturbance. The method can likewise serve for the starting of spinning, i.e., for the restart of a spinning process. The invention also concerns a spinning position, being equipped for the execution of the method according to the invention.

Speaking of air spinning frames, a device is to be understood for the production of a spun yarn from a fiber strand comprising a fiber guiding channel with a fiber guiding surface for the guiding of the fibers of the fiber strand into an inlet port of a thread guiding channel. The device also includes a fluid device for the generation of a turbulence around an inlet port of the thread guiding channel and the measure according to the invention for the influence of the flow conditions within the spindle channel of a stationary spindle.

Air spinning frames for the spinning of staple fiber materials usually comprise a large number of spinning positions, whereby, in each spinning position, a yarn is spun from a supplied longitudinal fiber structure. Thereby, the longitudinal fiber structure is first being refined, i.e., the fiber amount per unit of length becomes reduced by way of drafting.

The refined fiber strand is then spun into a yarn by generating a twist in the yarn. The yarn is then withdrawn and wound up. For the refinement, the longitudinal fiber structure is drafted, for example, by means of a drafting unit or dissolved with the help of a dissolving roller. For the yarn formation by means of twist generation, an air spinning method is used, i.e., the yarn formation is achieved by air twist generation.

After an interruption of the air spinning process where the connection between the spun thread and the refined fiber strand (longitudinal fiber structure) to be spun is broken, this connection must again be repaired, not only, so that the produced yarn is without interruptions, but also, that the spinning process can be started again. For such a reconnection of yarn and longitudinal fiber structure, in particular with air spinning methods, the free yarn end resulting from the interruption is pulled out upstream against the normal yarn conveying direction through the twist generating point and then positioned there. Thereafter, the thread take-off and the air twist generation means are again put into operation and the free front end (beginning) of the refined longitudinal fiber structure is supplied to the air twist generation, in such a manner that, during a short transition period, the end portion of the yarn and the front portion (beginning) of the fiber strand move together through the twist generation means. Thereby, by means of the twist generation, the fibers of the fiber strand are tangled with the fibers of the yarn end portion and the front portion of the yarn fiber strand is connected in a kind of splicing action with the end portion of the yarn. Thereby, the spinning process is again put into operation.

With the starting of the spinning, i.e., with a restart of a spinning process, it is possible to proceed in the same way, whereby, in place of the end portion of the yarn produced before the spinning interruption, an auxiliary yarn is used.

In order that the piecing part allows a trouble free continuation of the spinning process, for this purpose, the piecing part and its periphery must comprise a sufficiently large tear resistance, i.e., this usually means, that this tear resistance should be at least as high as the tear resistance of the yarn being produced in the momentary spinning process.

Different methods are known to achieve a sufficient tear resistance of the piecing part. These methods act at the free yarn end portion, at the free point portion of the refined fiber strand and/or at the timed coordination of the movement of the yarn end portion and the fiber strand front portion by means of the twist generation.

From the publication DE-4240653-A1, it is, for example, well known to roughen the yarn end portion and/or remove fiber ends from the dense fiber strand of the yarn and to branch them off from the yarn, whereby the tangling procedure with the newly supplied fiber improves and the tear resistance of the piecing part is being increased.

From the same publication, it is also known to prepare the yarn end portion for splicing in such a manner, that the fiber mass gradually decreases towards the yarn end and that the yarn itself thus tapers towards the end. A yarn end portion tapered in such a manner is then led overlapping through the twist generation point for the splicing with a correspondingly tapered front portion of a longitudinal fiber structure (gradually increasing fiber mass).

The use of a "pointed" front portion of a fiber strand for the piecing is for example described in the publication of the U.S. Pat. No. 5,802,831 (Murata). According to this publication, a longitudinal fiber structure is drafted in a drafting unit before the twist generation, whereby the drafting unit comprises a pre-drafting zone at the inlet side and a main drafting zone at the outlet side. After an interruption of the spinning process the intake of the longitudinal fiber structure into the drafting unit and the pre-draft is stopped. In that the main draft is not stopped, the longitudinal fiber structure is torn between the pre-drafting zone and the main drafting zone and forms a free front portion there. After the interruption the intake and the pre-draft are again synchronized accordingly with the twist generation means, coupled to the corresponding drive unit and the yarn take-off. The front portion of the longitudinal fiber structure, which is assumed to have a tapered form caused by the tearing off action, is thereby first subjected to the main draft, whereby it is assumed that the tapering mentioned is stretched accordingly and thus presents an improved piecing part.

The method according to U.S. Pat. No. 5,802,831 is still refined according to the publications U.S. Pat. Nos. 5,809,764 and 5,934,058 (both Murata), in that the tapering front portion of the longitudinal fiber structure, before the stretching, is shortened by a short part by tearing off, and in that, in a draft of air, which is applied between the drafting unit and the twist generation point, the fiber mass of this front portion is additionally and accordingly reduced.

It does show that it is difficult to prepare piecing parts with the methods mentioned which will meet the requirements. The yarns pieced according to the methods mentioned tend to have a weak point with a too low fiber mass immediately after a piecing point. For this reason, an up to 200% increased fiber mass in relation to the remaining yarn is usually added to the piecing part, thus a safely sufficient tear resistance is given for the starting of the spinning.

The U.S. application, Publication No. US 2002/0144496, which corresponds to an older European application of the applicant (EP 01129189,5), is also concerned with this problem, and its content is taken as an integrating part of this application. The object of this older application is supplemented by the present invention.

Besides the piecing quality (strength of the piecing part), the state of the art of the piecing or the process for the starting of the spinning has still a further disadvantage. With these methods, the piecing procedure is not always successful, so that the ratio of failed piecing procedures in relation to the total number of piecing procedure attempts is relatively high.

OBJECTS AND SUMMARY OF THE INVENTION

A principle object of the invention is now to provide a method and device for the piecing or the starting of spinning which comprises a high probability of success of the piecing procedure and with that, the quality of the piecing points, in particular the tear resistance, is being improved. Additional objects and advantages of the invention will be set forth in part in the following description, or may be obvious from the description, or may be learned through practice of the invention.

The method according to the invention is based on the observation that the chances for a successful piecing procedure are substantially higher, if the overlapping end portions of the yarn end and the torn longitudinal fiber structure are pressed together in the overlapping condition. By pressing together the fibers of the yarn end and the longitudinal fiber structure (i.e., fiber strand), the friction forces acting between the fibers (i.e., static friction forces) are increased. This increased adherence of the end portions has a positive effect on the succeeding process of the piecing procedure. It reduces in particular the probability that the end portions, thus "soldered together", will separate again before (upstream) the means for twist generation or within the means for twist generation, e.g., during the twist generation by means of air, and thereby reduces the piecing procedure failures. The process reliability of the piecing or the starting of the spinning and thereby also the process reliability of the air spinning frame is thus increased.

In addition, it has been found that surprisingly the piecing quality concerning the tear resistance is improved. Thereby, it is not necessary any longer that the piecer and/or the piecing point comprise an up to 200% increased fiber mass to obtain a sufficient tear resistance in relation to the remaining yarn. The piecing part comprises thus a substantially smaller sized thick part. Thanks to the tear resistance, the length of the piecing part can also be chosen to be shorter. In that both the fiber mass and the length of the piecing part are reduced, the disadvantages which are connected with a piecing part will also be reduced.

Pressing together the overlapping end portions of the yarn end and the torn longitudinal fiber structure is preferably realized by means of the given possibilities, i.e., without additional devices. Particularly suitable for this is the clamping point of the part of the fineness influencing unit (e.g., the pair of discharge rollers in the main draft of the drafting units) driven at the outlet side. Fundamentally, according to the idea of the invention, it would also be possible to provide a specific clamping or pressing device for the piecing procedure, by which device the yarn end and the torn longitudinal fiber structure are pressed together.

The variation to roughen or to taper the yarn end and/or its overlapping end portion, e.g., with a device according to DE4240653-A1, has also proved advantageous, but not essentially necessary. The application of a pointed end portion of the longitudinal fiber structures, e.g., according to U.S. Pat. No. 5,802,831, is also possible.

The method according to the invention and its device is now described by way of an exemplified embodiment. The exemplified embodiment is described by way of FIG. 1. It is to be pointed out explicitly, however, that the claimed invention is not limited to the exemplified embodiment shown.

DETAILED DESCRIPTION

Figure 1:
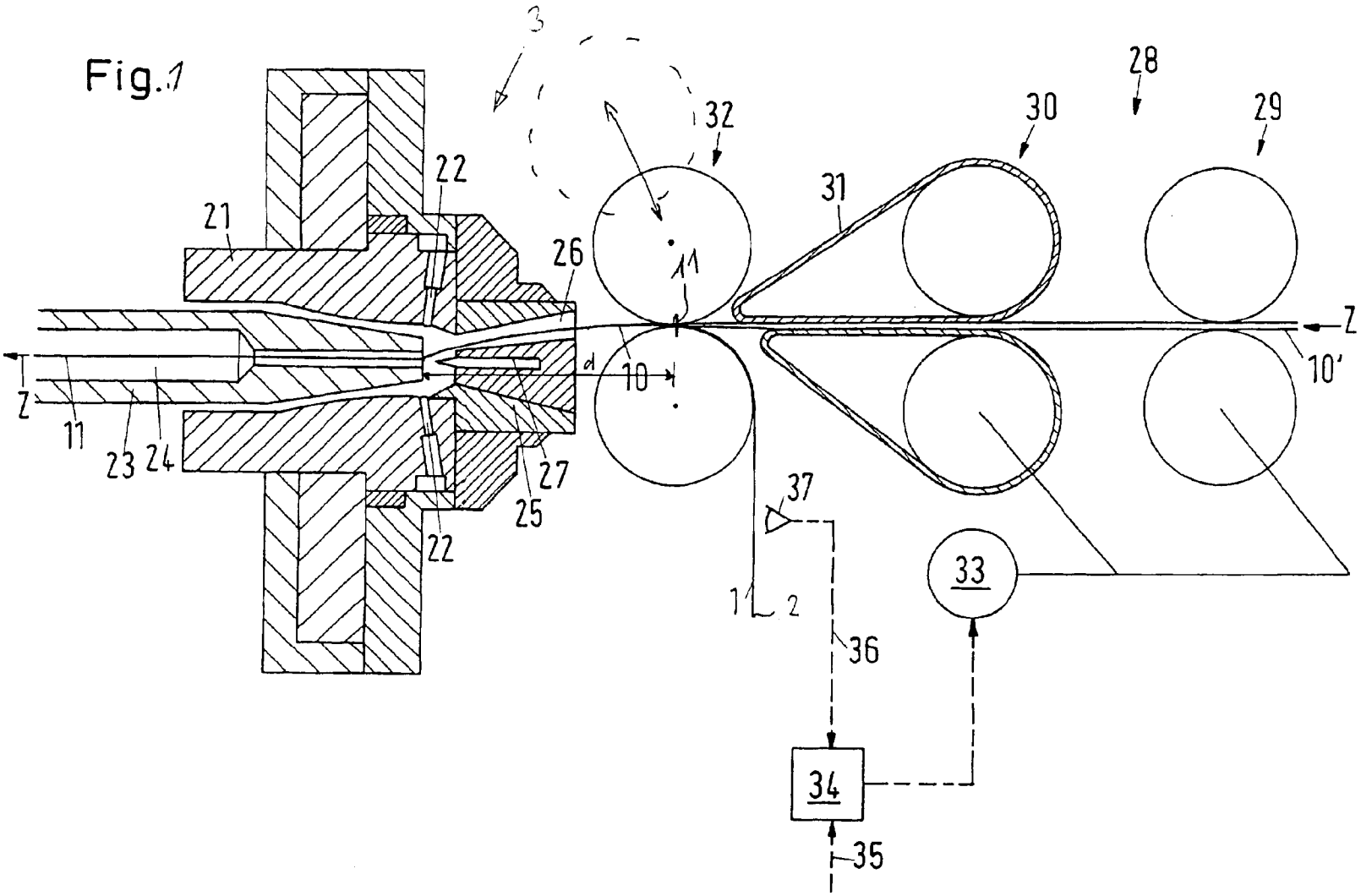
FIG. 1 shows a spinning position of an air spinning frame according to the present invention.

Reference will now be made in detail to the presently preferred embodiments of the invention, one or more examples of which are shown in the figure. Each example is provided to explain the invention, and not as a limitation of the invention. In fact, features illustrated or described as part of one embodiment can be used with another embodiment to yield still a further embodiment. It is intended that the present invention cover such modifications and variations.

FIG. 1 shows an exemplary embodiment of a spinning position of air spinning frames to carry out the method according to the invention. This spinning position is equipped for a so-called air spinning method with refinement by drafting. The spinning position is furnished with an air twist generator 2 with a nozzle block 21 having nozzles 22 incorporated therein. A spindle 23 with a thread channel 24 and a supply block 25 having a fiber feed channel 26 and a needle 27 directed towards the inlet of the thread channel 24 is also provided. For the refinement, the spinning position has a fineness influencing unit, a drafting unit 28, with, for example, three pairs of cylinders (intake cylinder 29, central cylinder 30 with tapes 31 and outlet cylinder 32 with clamping point 11).

The intake of the drafting unit 28, for example, the intake cylinders 29 and the central cylinders 30 with tape 31, are driven by a motor 33. The motor 33 is controllable by a control unit 34. For the controlling of the motor 33, the control unit 34 evaluates a return light 35 (ready signal) and a yarn end signal 36 for the determination of the accurate position of the end 2 of yarn end 1 of from a yarn end sensor 37, as well as a spinning position specific parameter.

During the actually known spinning process in the spinning position, according to FIG. 1, the longitudinal fiber structure 10' supplied in conveying direction Z runs between the intake cylinders 29 into the refinement means, and is subjected to a pre-draft between the intake cylinders 29 and the central cylinders 30 with a usually constant drafting ratio. Between the central cylinders 30 and the output cylinders 32, it is subjected to a main draft with, if applicable, a variable drafting ratio. The refined longitudinal fiber structure 10 is sucked from the output cylinders 32 through the fiber feed channel 26 towards the inlet of the thread channel 24. Compressed air, supplied by the nozzles 22, generates, apart from the suction mentioned, a turbulence within the zone of the thread channel inlet, which serves as the twist generation. The yarn 11 resulting from this twist generation is taken off through the thread channel 24 in take-off direction Z (the means for the thread take-off are not illustrated).

During an interruption of the spinning process, for example, in case of a yarn break or bobbin change, first the motor 33 is stopped, while the output cylinders 32 keep running for at least a limited period of time. Thereby, the supplied longitudinal fiber structure 10' is tom between the tape 31 and the output cylinders 32 and the piece, which is positioned downstream, is removed from the drafting unit by the output cylinders 32. Afterwards, the piece that remains downstream is disposed of if necessary, whereby the twist generator 3 is cleaned if required.

For the positioning of the free yarn end after an interruption of the spinning process, the upper or lower part of the supply block 25 and the upper or lower output cylinder 32 can, for example, be lifted off their working position in such a manner that the fiber feed channel 26 and the passage between the output cylinders 32 are made accessible for a return and a positioning of the yarn end 1.

For the resumption of the spinning process, the yarn end 1, which is unwound from the bobbin or which can be an auxiliary yarn (bobbin change), is withdrawn and/or returned within a spinning position up to the main drafting zone between the central cylinders 30 and/or the tapes 31 and the output cylinders 32 and hangs freely around the lower output cylinder 32, where it is detected by the yarn end sensor 37 (in particular its end 2). During the return through the nozzle block 21 and/or thread channel, auxiliary means, e.g., a suction device, can be used. During the subsequent positioning of the yarn end 1 on the output cylinders 32, it is to be made certain that the yarn end 1 is arranged in alignment with the longitudinal fiber structure 10', in particular within the clamping point 11 (not visible in the illustration in FIG. 1).

The process for the starting of the spinning within a spinning position, as illustrated in FIG. 1, is controlled as follows: if the yarn end 1 is positioned and all relevant parts of the spinning position have been repositioned into their working position, then the return signal 35 is transmitted to the control unit 34, for example by the personnel or by a piecing robot. Afterwards, the control unit starts the process for the starting of the spinning. That means that the twist generation for the air twist generator 3 and the thread take-off, that (if necessary with a predetermined graduation), so that the yarn end 1 starts to move itself towards the twist generation place. As soon as the yarn end sensor 37 detects the passing of the effective end 2, the control unit 34 receives the yarn end signal 36, by which then the actual piecing routine is started. After a delay, which depends first on the relative position of the end 2 (sensed by the yarn end sensor 37), second on the position of the beginning of the end portion of the longitudinal fiber structure 10' (shortly before the clamping line 11), and third on the desired length of the overlapping end portion, the motor 33 is started. The motor 33 brings the pairs of rollers 30 and 29 up to a speed, synchronized with the output cylinders 32, within a very short time (hundredth of seconds), so that, at the time of the overlapping of the first fibers of the end portions of the yarn end 1 and the longitudinal fiber structure 10', the rollers already rotate against each other at the correct speed ratio. The rollers can already comprise the respective nominal or operating speed, (i.e., speed of the normal, stationary spinning process) at the beginning of the spinning or piecing process. It is, however, also conceivable that the starting of the spinning and/or the piecing process takes place at a lower speed level. After the starting of such spinning, all turning rollers of the fineness influencing unit synchronously run-up to their respective nominal or operating speed (e.g., on a ramp with a gear).

For such a piecing routine, it might be necessary that the control unit 34 also provides data concerning the starting profile of the output cylinders 32, the central cylinders 30 and the intake cylinders 29, as well as the thread take-off (not illustrated). Also, if necessary, the control unit 34 can measure data of correspondingly arranged speed sensors.

If necessary, the air twist generator 3, i.e., in the present case, the speed of the air supplied from the nozzles 22, in order to accomplish the piecing point, can be changed in relation to the normal spinning process, for example it can be increased to obtain a stronger turbulence for fiber tangling.

The drafting unit 28, arranged upstream of the air twist generator 3 in a spinning position, can also comprise only two or more than three pairs of cylinders, whereby, during a spinning interruption, an intake-side part of the pairs of cylinders is stopped before an outlet side part of the pairs of cylinders. Thereby, after the spinning interruption, at least the intake-side part of the pairs of cylinders is run-up delayed, according to a predetermined ramp or according to a ramp determined by sensor signals. In FIG. 1, the central cylinders 30 and intake cylinders 29 present the part (by the motor 33) drivable at the intake-side of the fineness influencing unit (here drafting unit 28), while the output cylinders 32 present the parts drivable at the output- side.

For the start of the spinning or the method of piecing according to the invention for spinning positions of air spinning frames, which produce a thread from a longitudinal fiber structure during a spinning process, several things are required. A fineness influencing unit (e.g., a drafting unit) with parts drivable at the intake side (e.g., a pre- draft) and at the outlet side (e.g., a main draft) is needed, whereby at least the part drivable at the outlet-side comprises a clamping point. An air twist generator (vortex) and thread take-off are also needed.

The methods according to the invention comprise, after an interruption of the spinning process for the resumption of the production of the thread, the following steps—to be carried out substantially in this order—(whereby it is assumed that all structural components are stopped). The fineness influencing unit (e.g., drafting unit) is started up with the parts drivable at the intake side (e.g., intake cylinder and central cylinder with tape) and at the outlet side (e.g., output cylinders). The longitudinal fiber structures are torn by stopping the drive unit of the part driven at the intake side (intake and central cylinder) and, only subsequently, by stopping of the part driven at the outlet side (output cylinder), whereby the longitudinal fiber structure is torn at a rather accurate point between both parts, determinable by means of tests. The yarn end is returned to where spinning or piecing is to be started, first through the means for the thread take-off, then by the means for the twist generation (e.g., twist generator 3) and finally through the part driven at the outlet side of the fineness influencing unit (output cylinder of the drafting unit). The position of the end of the yarn end is registered when the end of the yarn end has reached a pre-determined position. The air twist generator (e.g., generator 3), the thread take-off and those parts driven at the inlet side as well as on the outlet side of the fineness influencing unit are started up.

Before the air twist generator and thread take-off start up, the yarn end is returned through the part of the fineness influencing unit driven at the outlet side by opening the part of the fineness influencing unit driven at the outlet side. The yarn end in the part of the fineness influencing unit driven at the outlet side is aligned with the longitudinal fiber structure in the part driven at the intake side. The part of the fineness influencing unit driven at the outlet side is closed. The part of the fineness influencing unit driven at the outlet side is started up together with a take-off of the yarn end through the part driven at the outlet side (output cylinder). These start-ups are followed by a time coordinated and delayed start-up of the part driven at the intake side in such a manner that the end portions of the torn longitudinal fiber structures and of the yarn end overlap and in the overlapping condition pass the clamping point of the part driven at the outlet side.

It is obvious that these steps should be substantially carried out in the above-indicated sequence. The invention is, however, not limited to this order, e.g., the step "determination of the position of the end of the thread end" can take place at different points of time.

The same applies for the first two steps:

start-up of the fineness influencing unit (e.g. drafting unit) with the parts drivable at the intake side (e.g. intake cylinder and central cylinder with tape) and the parts drivable at the outlet side (e.g. output cylinder); and tearing of the longitudinal fiber structures by stopping the drive unit of the part driven at the intake side (intake and central cylinder) and only stopping the part driven at the outlet side afterwards (output cylinder off), whereby thus the longitudinal fiber structure is torn at a rather accurate point between both parts, determinable by way of tests.

These two steps are facultative for the actual piecing procedure, because it is to be assumed that with a production stop, the spinning position first stops the drive unit of the part driven at the intake side (intake and central cylinder) and only afterwards the part driven at the outlet side (output cylinder) (normal process). These two steps thus must have preceded the piecing procedure.

In a further variation of the method, the position of the end of the yarn end is registered by respective means and transmitted to a control unit, which, at the resumption of the production of the thread, delays the start-up of the part driven at the intake side of the fineness influencing unit, timed in such a manner that the end portions of the torn longitudinal fiber structures and the yarn end overlap on a predetermined length.

In a preferred embodiment of the invention, the length of the overlapping end portions essentially corresponds with the spinning distance d of the spinning position (see FIG. 1). Thereby, the spinning distance d is defined as the distance between the port of the spindle 23 and the clamping line and/or the clamping point 11 of the output cylinder 32. It is also possible that this length of the overlapping end portions is longer than the spinning distance d of the spinning position mentioned.

In a further embodiment of the invention, the end portion of the yarn end 1, which is to overlap, is roughened or tapered.

The spinning position equipped for the execution of the method according to the invention comprises its own integrated controllable drive unit in the spinning position for the parts on the inlet side of the refinement means or a correspondingly controllable gear unit between these parts on the inlet side of the refinement means and a central gear unit. The further parts of the spinning position to be driven can be driven by simply coupling onto central drive units or also by drive units integrated in the spinning position, which are, if necessary, controllable.

The invention also comprises a spinning position of an air spinning frame according to the invention. This corresponds in its configuration with the exemplified embodiment according to FIG. 1, this is why reference is made here to the description of FIG. 1. The spinning position according to the invention contains a fineness influencing unit (drafting unit 28) with parts drivable at the inlet side 29, 30 and at the outlet side 32, whereby at least the part drivable at the outlet side if furnished with at least one clamping point 11. Furthermore, the device comprises an air twist generator 3, a thread take-off, with a means for the determination of the position of the end 2 of the yarn end 1. According to the invention the part of the fineness influencing unit 28 driven at the outlet side 32 can be opened in such a manner that its clamping point, or clamping points, 11 lie free for a return and a positioning of the yarn end 1.

In a preferred embodiment of the invention, the part driven at the outlet side consists of at least one pair of output cylinders (32), whereby the upper or the lower cylinder of the pair of output cylinders 32 can be lifted (see arrow and chain dotted roller in FIG. 1).

In a further embodiment, the invention can provide that the air twist generator (3) comprises a twist stop (27) being effective for the yarn end 1. As an example, a needle 27 is shown here. The particular feature is that the twist stop (27) is effective for the yarn end and not only for the longitudinal fiber structure. This twist stop (27) permits particularly good piecings.

It would also be conceivable that, in place of the clamping point 11 of the output cylinders 32, an additional device took over the function of the clamping point, i.e., the pressing together of the overlapping end portions of the yarn end (1) and the longitudinal fiber structure (10'), for the piecing procedure. Such a device would afterwards by swiveled away.

The invention is not limited to the explicitly mentioned possibilities and embodiments. These variations are rather meant as a suggestion for one skilled in the art, in order to implement the idea of the invention as favorably as possible. Further, favorable applications and combinations are, therefore, easily derivable from the described embodiments, which, likewise, represent the idea of the invention and which are included in the present invention. Some of the disclosed features were described in this description in combination and are jointly claimed in the following claims. It is, however, also conceivable to claim individual features of this description on their own or in other combinations in the application of the idea of the invention. The applicant therefore expressly reserves any different combinations within the scope of the application of the idea of the invention as its own.

What is claimed is:

1. A method for at least one of starting a spinning process and piecing a yarn end within a spinning position of an air spinning frame, the method comprising steps of:

returning a yarn end from a thread take-off through a twist generator of the air spinning frame;

opening a drivable pair of output cylinders at an outlet of a drafting unit;

placing the yarn end between the pair of output cylinders in alignment with a longitudinal fiber structure in a drivable inlet side of the drafting unit;

closing the drivable pair of output cylinders with the yarn end between the output cylinders so that the drivable pair of output cylinders form a clamping point;

determining an end position of the yarn end after the yarn end is placed between the output cylinders;

starting the drivable pair of output cylinders at the outlet of the drafting unit so that the yarn end moves toward the twist generator; and starting the drivable inlet side of the drafting unit subsequent to the starting of the drivable pair of output cylinders in a coordinated and delayed manner, so that end portions of the longitudinal fiber structure and the yarn end overlap each other as both the yarn end and the longitudinal fiber structure pass through the clamping point of the drivable pair of output cylinders.

2. A method as in claim 1, further comprising a first step of tearing the longitudinal fiber structure at the drivable inlet side of the drafting unit by running the drivable pair of output cylinders and the drivable inlet side of the drafting unit, then stopping the drivable inlet side of the drafting unit before stopping the drivable pair of output cylinders.

3. A method as in claim 1, wherein the drivable pair of output cylinders and the drivable inlet side of the drafting unit start at a lower speed level than an operating speed level at which the drafting unit runs, whereby the drivable pair of output cylinders and the drivable inlet side of the drafting unit synchronously increase speed to the operating speed level after the at least one of the starting of the spinning process and the piecing of the yarn end.

4. A method as in claim 1, wherein the end position of the yarn end is determined by registering the end of the yarn end by a yarn end sensor.

5. A method as in claim 4, further comprising the steps of transmitting the end position of the yarn end to a control unit that delays the starting of the drivable inlet side of the drafting unit in a timed manner to allow the end portions of the torn longitudinal fiber structure and the yarn end to overlap for a predetermined length.

6. A method as in claim 5, wherein the length of the overlapping end portions of the torn longitudinal fiber structure and the yarn end corresponds to the spinning distance between the clamping point of the drivable pair of output cylinders and a port of a spindle within the twist generator.

7. A method as in claim 5, wherein the length of the overlapping end portions of the torn longitudinal fiber structure and the yarn end is longer than the spinning distance between the clamping point of the drivable pair of output cylinders and a port of a spindle within the twist generator.

8. A method as in claim 1, wherein the end portion of the yarn end that overlaps the longitudinal fiber structure is roughened before the starting of the drivable pair of output cylinders.

9. A method as in claim 1, wherein the end portion of the yarn end that overlaps the longitudinal fiber structure is tapered before the starting of the drivable pair of output cylinders.

10. A spinning position of an air spinning frame for spinning a fiber longitudinal structure into a yarn, said spinning position comprising:

a drafting unit having a drivable pair of output cylinders and a drivable inlet side with said drivable pair of output cylinders forming a clamping point;

a twist generator disposed proximal to said drivable pair of output cylinders, said twist generator having a fiber feed channel through which drafted fibers are fed, nozzles that create a twisting air flow, and a spindle with a yarn channel through which the formed yarn travels;

said drivable pair of output cylinders being separable to allow the insertion and alignment of a yarn end between the clamping point permitting at least one of starting of the spinning process and piecing of the yarn end; and a yarn end sensor positioned proximal to said drivable pair of output cylinders of said drafting unit, said yarn end sensor determining an end position of the yarn end.

11. A spinning position as in claim 10, wherein said drivable pair of output cylinders and said drivable inlet side of said drafting unit are driven independent of each other.

12. A spinning position as in claim 10, further comprising a control unit operably connected to said drafting unit, said twist generator and said yarn end sensor, said control unit controlling the at least one of the starting of the spinning process and the piecing of the yarn end.

13. A spinning position as in claim 10, wherein said drivable inlet side of said drafting unit includes a pair of intake cylinders.

14. A spinning position as in claim 13, wherein said drivable inlet side of said drafting unit includes a pair of central cylinders located between said pair of intake cylinders and said pair of output cylinders, thereby forming a pre-draft between said pair of intake cylinders and said pair of central cylinders.

15. A spinning position as in claim 14, wherein said central cylinders include tapes to control the draft between said central cylinders and said output cylinders.

16. A spinning position as in claim 10, wherein at least one of a lower cylinder or an upper cylinder of said drivable pair of output cylinders is movable.

17. A spinning position as in claim 10, wherein said twist generator includes a twist stop proximal to said fiber feed channel.

18. A spinning position as in claim 17, wherein said twist stop comprises a needle.

* * * * *